US005285743A

United States Patent [19]

Connolly

[11] Patent Number: 5,285,743

[45] Date of Patent: Feb. 15, 1994

[54] DRY DOCK

[76] Inventor: Patrick Connolly, 402-2950 Heather Street, Vancouver, British Columbia, V5Z 3J8, Canada

[21] Appl. No.: 850,721

[22] Filed: Mar. 13, 1992

[51] Int. Cl.[5] ..... B63C 1/02

[52] U.S. Cl. ..... 114/45

[58] Field of Search ..... 114/45–48, 114/44; 405/3–7

[56] References Cited

U.S. PATENT DOCUMENTS

| | | | |
|---|---|---|---|
| 1,412,852 | 4/1922 | Engstrand | 114/45 |
| 3,293,866 | 12/1927 | Foster | 61/65 |
| 4,084,529 | 4/1978 | Katernberg | 114/46 |

FOREIGN PATENT DOCUMENTS 1505838 9/1989 U.S.S.R. .

*Primary Examiner*—Sherman Basinger

[57] ABSTRACT

A dry dock system comprising a first floating dock able to receive at least one vessel and being controllably submersible. The second dry dock able to receive a vessel and dimensionally received in the first dock. The second dock has sea valves that, when opened, allow the second dock to fill on submerging and drain on raising and, when closed, allow the second dock to float. The first dock is dimensioned so that it can contain the first dry dock and at least one vessel simultaneously. A method of dry docking is also disclosed. The method comprising submerging the first dry dock. Positioning the second dry dock having sea valves over a chosen area of the first dock. The first dock is raised to contact the second dry dock. The sea valves of the second dry dock are open and the first dry dock is then submerged. The second dry dock submerges with the first and remains in contact with the first dry dock. The first dry dock may then be raised. The second dry dock is raised with it. The second dry dock drains on being raised and can be refloated independently of the first dry dock.

2 Claims, 1 Drawing Sheet 10
11
12
14
16
17
18

DRY DOCK

FIELD OF THE INVENTION

This invention relates to a dry dock system and to a method of dry docking a plurality of vessels.

DESCRIPTION OF THE PRIOR ART

A dry dock is an essential part of ship building and ship repair, particularly the latter. A dry dock is a means of taking a ship from the water so that work can be carried out, notably on the hull.

A dry dock is a massive construction able to support a substantial vessel. In general, a dock-yard will have the largest feasible dry dock, that is large enough to support the largest vessels that it works on frequently.

A large dry dock can frequently hold a plurality of vessels. The only requirement is that the vessels be able to fit within the dock. However, as a rule, both vessels must be dry docked at the same time and both vessels must leave the dry dock at the same time. It is therefore important to choose two vessels requiring work that will take similar time.

This is not always possible. When it is not possible, two vessels can still be repaired at the same time but when it is required to re-float one vessel, the other vessel must be made at least floatable, so that the first vessel can be removed. When work is progressing on the other vessel this is a tedious and time-consuming procedure, and expensive.

Prior art known to applicant includes U.S. Pat. Nos. 4,084,529 to Katernberg and 3,293,866 to Foster and U.S.S.R. Patent 1,505,838.

Katernberg discloses a floating dry dock system having a central box-like dry dock which may include a bottom and a side wall on each side and a lifting pontoon associated with the central unit and able to be flooded so that it can be positioned completely across the bottom of the central unit. The pontoon is made of a size sufficient to permit it to be ballasted to raise the central unit above the level of the water. Katernberg seeks to simplify the design and construction of dry docks and does not require skilled seamanship to use.

Foster teaches an improved technique for dry docking large ships and for launching large ships built in a dry dock. Foster discloses a step of cradling the ship in a floating cradle structure while the ship floats. The cradle structure is then buoyed to elevate the cradle structure and the ship to a draft elevation where the undersides of both are higher than the elevation of the dry dock floor. This ensures floating clearance of the cradle structure and the ship with respect to the dry dock floor. The dry dock may then be flooded to float the buoyed cradle structure and ship within the dry dock.

The Russian patent is to a method of operating a floating dock having Kingston valves and movable end covers. These end covers are positioned above bottom supports. The Kingston valves are opened and the dock lands on the support. The covers are then opened after which the ship is brought into the floating dock. The covers are then closed. With a flow tide, the floating dock, including the covers is lifted and set above the bottom supports. Water enters the dock chambers due to gravity feed. The dock then submerges and is seated on the supports.

None of this prior art addresses the problem of having two vessels in the dry dock and removing one vessel from the dry dock with a minimum of inconvenience, particularly to the crew working on the retained vessel.

There is therefore a clear need to develop a dry docking system that allows carrying out a refit on a plurality of vessels in one dry dock regardless of the time required to refit each vessel.

This need is met by the present invention.

SUMMARY OF THE INVENTION

Accordingly, in a first aspect the present invention is a dry dock system comprising a first dry dock able to receive at least one vessel and being controllably submersible, a second floating dock able to receive a vessel and able to be received in the first dry dock, said second dock having sea valves that, when open, allow the second dry dock to fill on submerging and drain on raising and, when closed, allow the second dry dock to float, said first dry dock being dimensioned so that it can contain the second dry dock containing the second vessel and said at least one vessel simultaneously.

In a further aspect, the present invention is a method of dry docking comprising submerging a first dry dock that is controllably submersible, positioning a second dry dock having sea valves over a predetermined area of the first dry dock, raising the first dry dock to contact the second dry dock, opening the sea valves of the second dry dock, submerging the first dry dock, the second dry dock submerging in contact with the first dry dock.

In yet a further aspect the present invention is a method of dry docking a plurality of vessels comprising submerging a first dry dock that is controllably submersible, positioning a second dry dock having sea valves above a predetermined area of the first dry dock, raising the first dry dock to contact the second dry dock, opening the sea valves on the second dry dock, submerging the first dry dock, the second dry dock submerging with the first dry dock and remaining in contact with the first dry dock, positioning a vessel over the second dry dock, raising the first dry dock, and with it the second dry dock, to contact and raise the vessel with the second dry dock, submerging the first dry dock sufficiently to allow positioning of a second vessel on the first dry dock.

BRIEF DESCRIPTION OF THE DRAWINGS

The invention is illustrated in the drawings in which.

DESCRIPTION OF THE PREFERRED EMBODIMENTS

Figures 1, 2, 3, 4:
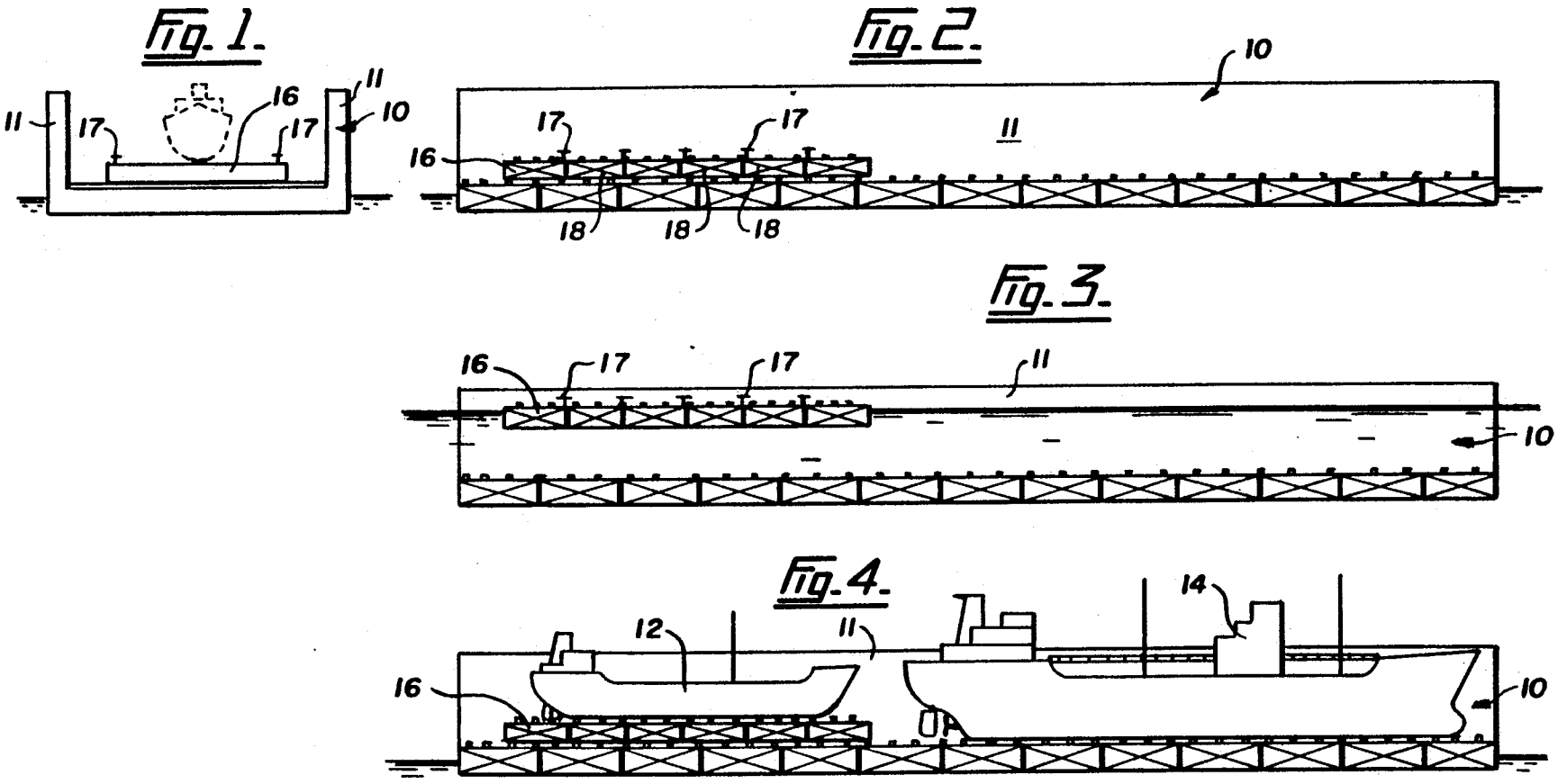
FIG. 1 is an end view of a dry dock system according to the present invention.
FIG. 2 is a side elevation of the system of FIG. 1.
FIG. 3 illustrates the carrying out of the method of the present invention.
FIG. 4 illustrates the dry dock of the present invention with two vessels in place.

In the drawings, two dry docks are illustrated. The structure of each dry dock is entirely conventional. That is to say the structure required to provide the necessary strength involves well known skill in the art. The docks will typically be flat-decked and carry keel blocks to support vessels.

The drawings show a dry dock system comprising a first floating dock 10 having side walls 11 able to support vessels 12 and 14 and being controllably submersible. Dock 10 is a conventional dry dock in that it has extensive dock-yard equipment (not shown), is equipped with sea valves that allow its controlled submersion and with pumps that allow it to be pumped out while it is submerged. This allows the dock 10 to be refloated. Dock 10 will not sink completely below the water level, as shown in FIG. 3, because of the dock-yard equipment (cranes and the like) that it carries. This equipment must not, of course, be submerged.

There is a second floating dock 16 which receives vessel 12. The second floating dock 16 is also receivable in the first dock 10. The relative proportions of the two docks are such that the first dock 10 can receive the second dock 16 and a further vessel 14 as illustrated in FIG. 4. Second dock 16 is made up of a plurality of pontoons 18.

Unlike the first dock 10 the second dock 16 is completely submersible. It has sea valves 17 (illustrated diagrammatically) that, when open, allow the dock to flood on submersion and to drain on raising to the surface. When closed valves 17 keep water out of the dock 16 so that the dock can float and carry a vessel 12. Dock 16 is essentially in a mother/daughter relationship to dock 10. That is to say it cannot be raised without dock 10. Dock 16 has a ballasting system for trimming but relies on valves 17 to be open for drainage.

It is important that the system be dimensioned so that the second floating dry dock 16 does not interfere with dock yard equipment for the first dry dock 10. As a dry dock is required for carrying out major overhauls and refits of ships, it is important that cranes, power sources and all other equipment necessary in a modern dock-yard be present.

In using the system of FIGS. 1 to 4 to dry dock the two vessels 12 and 14, the following procedure can be used:

First the first dry dock 10 is submerged to the level shown in FIG. 3, which is the maximum extent of submersion that the dock is designed to allow. The second dock 16, with the sea valves 17 closed, is floated above a predetermined area of the first dock 10. The first dock 10 is then raised. It contacts the second dry dock 16 and raises dock 16 above the surface of the water.

The valves 17 on the second dry dock 16 are then opened. The first dry dock 10 is then controllably submerged. The second dry dock 16 remains in contact with the first dry dock and the open sea valves 17 ensure that water enters the dry dock 16 so that it sinks with the first dry dock 10.

The second vessel 12 is then floated over the submerged dry docks 10 and 16, over the second dry dock 16. The first dry dock 10 is then raised. The second dry dock 16 is raised with it. Dock 16 comes up below the vessel 12 and raises it from the water. The valves 17 are still open so that water drains from the second dry dock 16. Valves 17 are then closed.

The first dry dock 10 can now be submerged sufficiently to allow the vessel 14 to be introduced into it. This will necessitate floating of the second dock 16. First dock 10 is then raised to dock vessel 14 and the dock 16 which is carrying vessel 12.

When the necessary work is completed and it is desired to move vessel 14 from the dry dock, it is ensured that the sea valves 17 are still closed. Dry dock 10 can then be submerged sufficiently to allow the first vessel 14 to be floated. The dock 16 can float while the first vessel 14 is moved away. The second vessel 12 can then be readmitted to the dry dock 10 on the second dry dock 16.

Dry dock 16, with the vessel 12 in it, can always be floated away from dock 10 should it be necessary to submerge dock 10. Work can continue on vessel 12 while it floats on dock 16 and it is not necessary to make vessel 12 floatable to allow vessel 14 to be launched.

One advantage of the invention is that a large number of second dry docks 16 can be used, all in association with the relatively expensive, larger first dry dock 10. Furthermore, the dry docks, particularly the second dry dock 16, can be increased in size simply by attaching more pontoons 18 to it or by attaching two or even more dry docks 16 together.

The invention is applicable with all types of dry docks, for example graving dry docks, railway docks and lift dry docks.

I claim:

1. A method of dry docking a plurality of vessels comprising;

submerging a first dry dock that is controllably submersible;

positioning a second dry dock having sea valves above a predetermined area of the first dry dock;

raising the first dry dock to contact the second dry dock;

opening the sea valves on the second dry dock;

submerging the first dry dock, the second dry dock submerging with the first dry dock and remaining in contact with the first dry dock;

positioning a vessel over the second dry dock;

raising the first dry dock, and with it the second dry dock, to contact and raise the vessel with the second dry dock;

submerging the first dry dock sufficiently to allow positioning of a second vessel on the first dry dock.

2. A method as claimed in claim 1 including closing the sea valves on raising the second dock to render the dock floatable.

* * * * *